US007889148B2

(12) United States Patent
Diaz et al.

(10) Patent No.: US 7,889,148 B2
(45) Date of Patent: Feb. 15, 2011

(54) COMPACT BROAD-BAND ADMITTANCE TUNNEL INCORPORATING GAUSSIAN BEAM ANTENNAS

(75) Inventors: Rodolfo Diaz, Phoenix, AZ (US); Jeffrey Peebles, Phoenix, AZ (US); Richard LeBaron, Phoenix, AZ (US); Zhichao Zhang, Tempe, AZ (US); Lorena Lozano-Plata, Alcalá de Henares (ES)

(73) Assignee: Arizona Board of Regents for and on behalf of Arizona State University, Scottsdale, AZ (US)

( * ) Notice: Subject to any disclaimer, the term of this patent is extended or adjusted under 35 U.S.C. 154(b) by 588 days.

(21) Appl. No.: 12/004,310

(22) Filed: Dec. 19, 2007

(65) Prior Publication Data

US 2008/0309571 A1 Dec. 18, 2008

Related U.S. Application Data

(60) Provisional application No. 60/871,551, filed on Dec. 22, 2006.

(51) Int. Cl.
*H01Q 13/00* (2006.01)

(52) U.S. Cl. ..... 343/785; 343/786; 343/772; 343/773

(58) Field of Classification Search ..... 343/772, 343/773, 785, 786
See application file for complete search history.

(56) References Cited

U.S. PATENT DOCUMENTS

| | | | | |
|---|---|---|---|---|
| 5,684,495 | A * | 11/1997 | Dyott et al. | 343/785 |
| 6,720,933 | B2 | 4/2004 | Hanlin et al. | |
| 6,992,639 | B1 * | 1/2006 | Lier | 343/786 |
| 2002/0030632 | A1 * | 3/2002 | Popa et al. | 343/785 |
| 2002/0196194 | A1 * | 12/2002 | Lier | 343/786 |

OTHER PUBLICATIONS

Newham, P., "A wideband hybrid conical horn," Antennas and Propagation Society (AP-S) International Symposium , Philadelphia, PA, Jun. 8-13, 1986, pp. 103- 104.

Zhang, Z., "Design of the broadband admittance tunnel for high fidelity material characterization" Arizona State University, Dec. 2005 Doctorate Thesis [Abstract Only], 2 pages.

* cited by examiner

*Primary Examiner*—Douglas W Owens
*Assistant Examiner*—Dieu Hien T Duong
(74) *Attorney, Agent, or Firm*—Fish & Richardson P.C.

(57) ABSTRACT

A plane wave antenna including: a horn antenna; a waveguide at least partially inside the horn antenna, wherein the waveguide includes: a central dielectric slab increasing in width toward the horn antenna and with a first dielectric constant, an upper slab above the central dielectric slab with a second dielectric constant, and a lower slab below the central dielectric slab with the second dielectric constant; wherein the central dielectric slab has a substantially constant thickness less than a quarter of a wavelength at a highest frequency of operation of the plane wave antenna.

22 Claims, 12 Drawing Sheets

COMPACT BROAD-BAND ADMITTANCE TUNNEL INCORPORATING GAUSSIAN BEAM ANTENNAS

CROSS-REFERENCE TO RELATED APPLICATION

This application claims priority to and the benefit of U.S. Provisional Application No. 60/871,551 filed Dec. 22, 2006, the entire contents of which are expressly incorporated herein by reference.

FIELD

Broadband antennas or admittance tunnel incorporating the same are generally discussed herein, with particular discussions extended to a compact broadband antenna with a polyrod and/or an admittance tunnel incorporating a broadband antenna and an iris.

BACKGROUND

An admittance tunnel is generally defined as a test set-up for measuring the constitutive parameters of dielectric and magneto-dielectric materials in a plane-wave environment. One of its principal uses is to characterize lossy materials for absorption of electromagnetic energy, which may have attenuation constants in the range of 0.1 dB/inch to 40 dB/inch and relative permittivities in the range from 1.01 to 40. Man-made lossy materials manufactured in bulk quantities may possess local inhomogeneities in the materials. However, since in the typical applications large areas of the materials may interact with the incident wave, the properties measured should be representative of the overall average properties of the materials. Therefore, in these applications, microscopic profiling of the material is not desired. Further, destructive testing that requires many individual samples of the material to be machined to precise dimensions to fit inside a waveguide or transmission line set-up is highly undesirable.

SUMMARY OF THE INVENTION

An aspect of an embodiment of the present invention is directed toward a layered dielectric polyrod coupled to a broadband double-ridged waveguide horn to provide a substantial plane wave energy onto a sample in a compact domain. Another aspect of an embodiment of the present invention is directed toward a resistively loaded serrated iris in a ground plane that is utilized to support a sample and provide an isolation plane between two antennas of an admittance tunnel. The iris serrations and resistive load redirect and damp the edge diffraction away from the receiving antenna. As a result, an aspect of an embodiment of the present invention is directed toward an antenna system for providing a substantial plane wave interaction between an electromagnetic wave and a sample at an operation frequency ranging from 0.7 GHz to 20.0 GHz.

An embodiment of the present invention provides a plane wave antenna including: a horn antenna; a waveguide at least partially inside the horn antenna, wherein the waveguide includes: a central dielectric slab increasing in width toward the horn antenna and with a first dielectric constant, an upper slab above the central dielectric slab with a second dielectric constant, and a lower slab below the central dielectric slab with the second dielectric constant; wherein the central dielectric slab has a substantially constant thickness less than a quarter of a wavelength at a highest frequency of operation of the plane wave antenna.

The plane wave antenna may further include an iris between the waveguide and a test sample, wherein the iris has a serrated edge.

The central dielectric slab may have an arctangent curve shape toward the horn antenna.

The central dielectric slab may have an exponential curve shape toward the horn antenna.

The central dielectric slab may have a polynomial curve shape toward the horn antenna.

The upper slab and the lower slab may have an ellipsoid shape.

The first dielectric constant may be higher than the second dielectric constant.

The upper slab and the lower slab may be spaced apart from the central dielectric slab.

The horn antenna may be a broadband double-ridged horn antenna.

Another embodiment of the present invention provides a sample evaluating system including: a transmitter for transmitting an evaluation signal, the transmitter including a horn antenna and a waveguide at least partially inside the horn antenna, a receiver for receiving the evaluation signal; and a sample holder between the transmitter and the receiver, the sample holder including an iris having a serrated edge.

The waveguide may include: a central dielectric slab increasing in width toward the horn antenna and with a first dielectric constant an upper slab above the central dielectric slab with a second dielectric constant, and a lower slab below the central dielectric slab with the second dielectric constant; wherein the central dielectric slab has a substantially constant thickness less than a quarter of a wavelength at a highest frequency of operation of the plane wave antenna.

The central dielectric slab may have an arctangent curve shape toward the horn antenna.

The central dielectric slab may have an exponential curve shape toward the horn antenna.

The central dielectric slab may have a polynomial curve shape toward the horn antenna.

The upper slab and the lower slab may have an ellipsoid shape.

The first dielectric constant may be higher than the second dielectric constant.

The upper slab and the lower slab may be spaced apart from the central dielectric slab.

The horn antenna may be a broadband double ridged horn antenna.

Another embodiment of the present invention provides a waveguide including: a central dielectric slab increasing in width toward the horn antenna and with a first dielectric constant, an upper slab above the central dielectric slab with a second dielectric constant, and a lower slab below the central dielectric slab with the second dielectric constant; wherein the central dielectric slab has a substantially constant thickness less than a quarter of a wavelength at a highest frequency of operation of the plane wave antenna.

The central dielectric slab may have an arctangent curve shape toward the horn antenna.

The central dielectric slab may have an exponential curve shape toward the horn antenna.

The central dielectric slab may have a polynomial curve shape toward the horn antenna.

The upper slab and the lower slab may have an ellipsoid shape

The first dielectric constant may be higher than the second dielectric constant.

Another embodiment of the present invention provides a method of manufacturing a plane wave antenna, the method including: forming a waveguide, the method of forming the waveguide including: forming a central dielectric slab with a first dielectric constant, wherein the central dielectric slab is wider at a first end than at a second end, forming an upper dielectric slab with a second dielectric constant above the central dielectric slab; forming a lower dielectric slab with the second dielectric constant below the central dielectric slab; inserting at least a portion of the waveguide into a horn antenna; wherein the central dielectric slab has a substantially constant thickness less than a quarter of a wavelength at a highest frequency of operation of the plane wave antenna.

The method may further include forming an iris between the waveguide and a test sample, wherein the iris has a serrated edge.

The central dielectric slab may have an arctangent curve shape toward the horn antenna.

The central dielectric slab may have an exponential curve shape toward the horn antenna.

The central dielectric slab may have an polynomial curve shape toward the horn antenna.

The upper slab and the lower slab may form an ellipsoid shape.

The first dielectric constant may be higher than the second dielectric constant.

The upper slab and the lower slab may be spaced apart from the central dielectric slab.

The horn antenna may be a broadband double-ridged horn antenna.

BRIEF DESCRIPTION OF THE DRAWINGS

The accompanying drawings, together with the specification, illustrate exemplary embodiments of the present invention, and, together with the description, serve to explain the principles of the present invention.

The patent or application file contains at least one drawing/picture executed in color. Copies of this patent or patent application publication with color drawing/picture(s) will be provided by the Office upon request and payment of the necessary fee.

DETAILED DESCRIPTION

Figure 1:
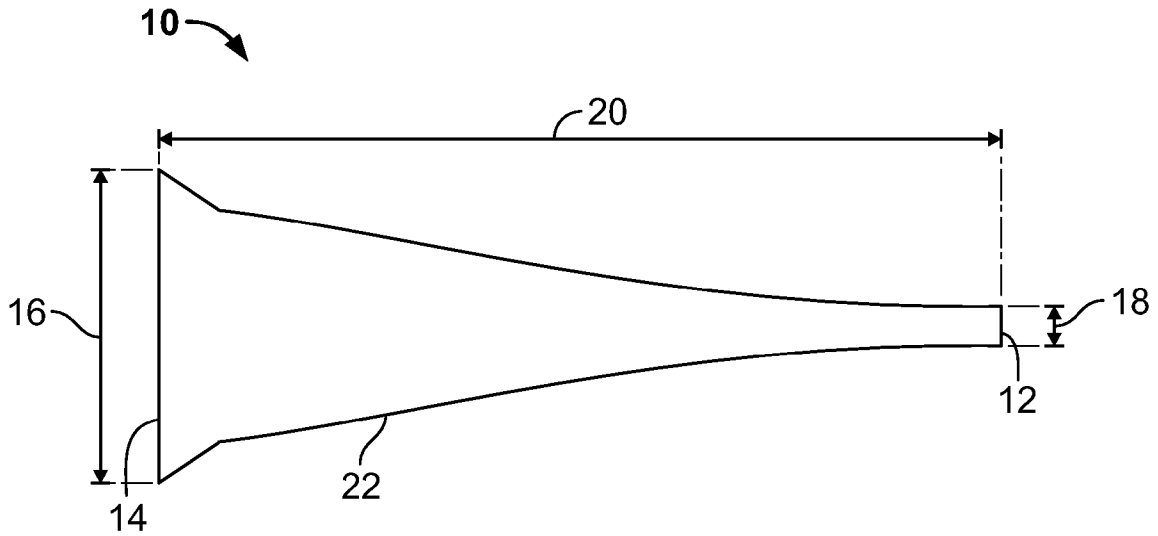
FIG. 1 is a schematic top view of a central dielectric slab of an embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Pursuant to an aspect of an embodiment of the present invention, because of the industry standard data-reduction algorithms used and because the ultimate application of the materials of interest involve their interactions with plane electromagnetic waves, it is desirable to create a close approximation to a plane wave environment at a sample under test. Further, it is also generally desirable to limit the size of the sample required for testing to less than 3 feet by 3 feet in cross section. Sample cross sections between 1 foot by 1 foot and 2 feet by 2 feet are common industry standards for material measurement.

An embodiment of the present invention is directed toward a compact broadband admittance tunnel for use as a material characterization test system, including a polyrod horn antenna for generating a Gaussian illumination spot that approximates plane wave conditions within a compact spatial domain and over a broad frequency spectrum (in a range from about 0.7 GHz to about 20.0 GHz). The resulting test system may be about 4 feet by about 4 feet by about 4 feet for measuring samples that range in size from about 1 foot by about 1 foot to about 3 feet by about 3 feet in cross section, and with thicknesses that range from about 0.002 inches to about 6 inches.

Figure 12:
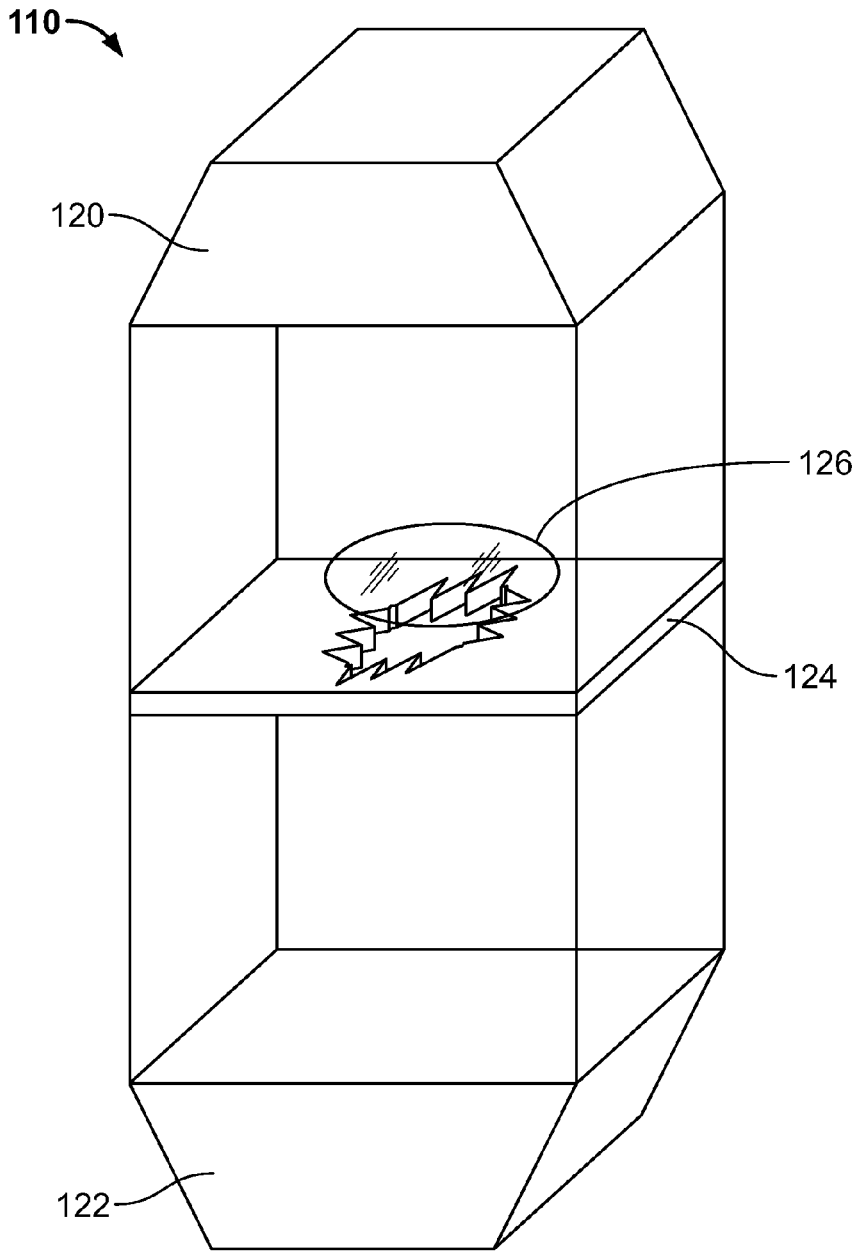
FIG. 12 is a schematic view of a compact broadband admittance tunnel.

As shown in FIG. 12, a compact admittance tunnel 110 in accordance with an embodiment of the present invention includes a transmitter 122 positioned across from a receiver 120. A sample holder 124 with an iris holds the sample 126 between the transmitter and the receiver 120, so that a signal from the transmitter 122 goes through the sample 126 before being received by the receiver 120.

A polyrod is a tapered dielectric waveguide variously used in RF and microwave communication applications as an end-fire antenna. A polyrod properly shaped and positioned in electromagnetic proximity to ridges of a broadband double-ridged horn antenna transfers electromagnetic energy guided by the ridges into a surface wave guided by the polyrod. The polyrod cross-section may then be reduced at a prescribed rate along its length to couple the guided surface wave into a radiating electromagnetic wave. Proper design of the polyrod cross section, including taper, total length, and material, provides a smooth transition of the electromagnetic energy into a radiating para-axial mode, also known as a Gaussian beam.

A polyrod of the present invention may result in a Gaussian beam waist (i.e., the region where the beam diameter is smallest and phase-fronts are substantially flat) substantially near the end of the polyrod. The Gaussian beam may have an axial region, where most of the energy is concentrated, surrounded by a region where the energy decays radially outwards, e.g.

decaying exponentially. The radial decay of the Gaussian beam minimizes interaction of the Gaussian beam with an iris, described below. Near the Gaussian beam waist, the Gaussian beam diameter changes slowly, enabling the user to position the polyrod-horn-antenna in a range from about 0.25 inches to about half a length of the polyrod from the sample to be measured without substantially changing performance of the test system.

A Gaussian beam spot-size (measured as the waist diameter, or alternatively as the half-power diameter of the beam) may decrease with frequency, f, more slowly than the function 1/f. Conventional "focused beam" tunnels achieve a small spot-size at a sample to be measured by using a system of lenses. Since plane waves have flat phase fronts and a converging spherical wave only attains a flat phase front at its focus, the sample is placed at the focal spot to obtain a flat phase front at the sample.

However, two undesirable effects result from this arrangement. First, the focal spot of a focused lens system typically scales linearly with wavelength, $\lambda$. The focal length of the lenses must be short for a compact test, resulting in the size of the focal spot being minimized. The minimum size is an uncertainty limit of $\lambda/\pi$. Here, the spot-size shrinks rapidly as frequency increases, so a small area of the sample (e.g. a fraction of an inch) is measured at high frequencies. Thus, the average properties of the sample are not measured, and local properties sensitive to material inhomogeneities and placement dominate measurements.

A second undesirable effect is anomalous behavior of the electromagnetic field near the focal spot, where phase velocity is greater than light-speed, and the region around the focal spot has hot-spots and null-like areas due to constructive and destructive interference. Here, the phase undergoes discontinuous jumps. As a result, only the center of the focal spot approximates a plane-wave, with uniform amplitude and flat phase. Since only one part of the sample may be at the focal spot, substantially all of the sample is not subjected to plane waves.

Conventionally, enlarging the focal spot and minimizing undesirable effects requires long focal-length lensed systems, increasing the size of the test system. The present invention is directed toward generating a smooth Gaussian beam with no hot-spots and a local phase velocity close to light-speed, because the spot size is larger than the uncertainty limit. Further, an aspect of the present invention provides a layered polyrod enabling an electromagnetic wave guided by double-ridges of a horn antenna to couple efficiently into a Transverse Magnetic (TM) dielectric slab surface wave.

As shown in FIG. 1, a polyrod of an embodiment of the present invention includes a central dielectric slab 10 that has a thickness of about 0.09 inches (or is in a range from about 0.06 inches to about 0.1 inches) and a dielectric constant of about 2.6 (or in a range from about 2 to about 3.5), with an arctangent curve shape 22 (or other suitable shapes, including an exponential curve shape or a polynomial curve shape) along a length 20 that may be about 17.01 inches (or range from about 12 to about 24 inches). An exponential shape, or other such smoothly varying shape suitable for distributed (continuous) microwave transformers, may also be used, where the guided TM slab wave is slowly released into a radiating wave to obtain a Gaussian beam profile for all frequencies of operation. A horn-end 14 may have a first width 16 of about 6 inches (or range from about 5 to about 9 inches) and a sample end 12 may have a second width 18 of about 0.77 inches (or range from about 0.1 to about 0.9 inches).

Figure 2B:
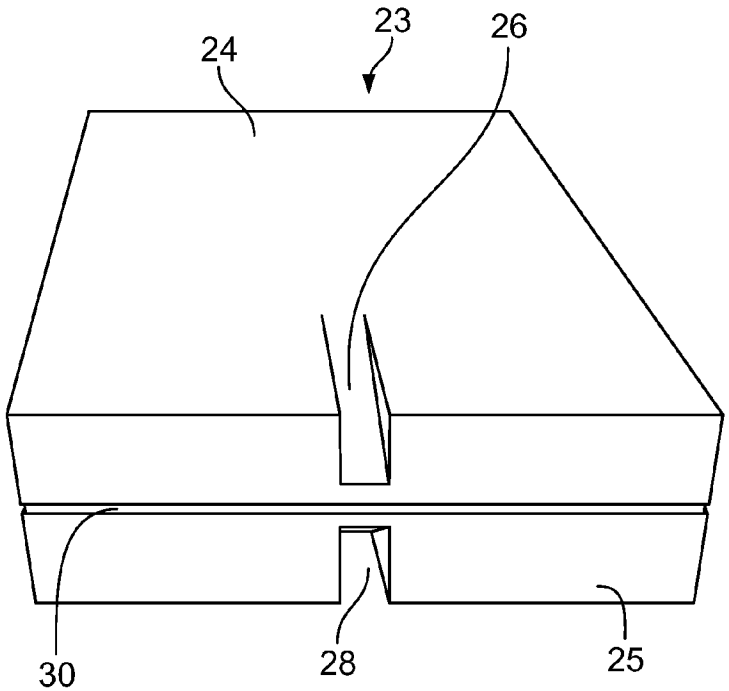
FIG. 2B is a photograph of a waveguide of an embodiment of the present invention.
Figure 2A:
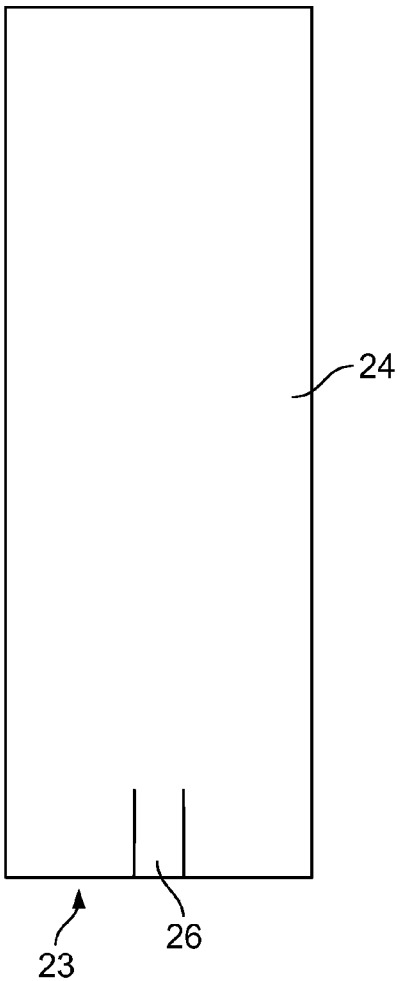
FIG. 2A is a photograph of a waveguide of an embodiment of the present invention.
Figure 3:
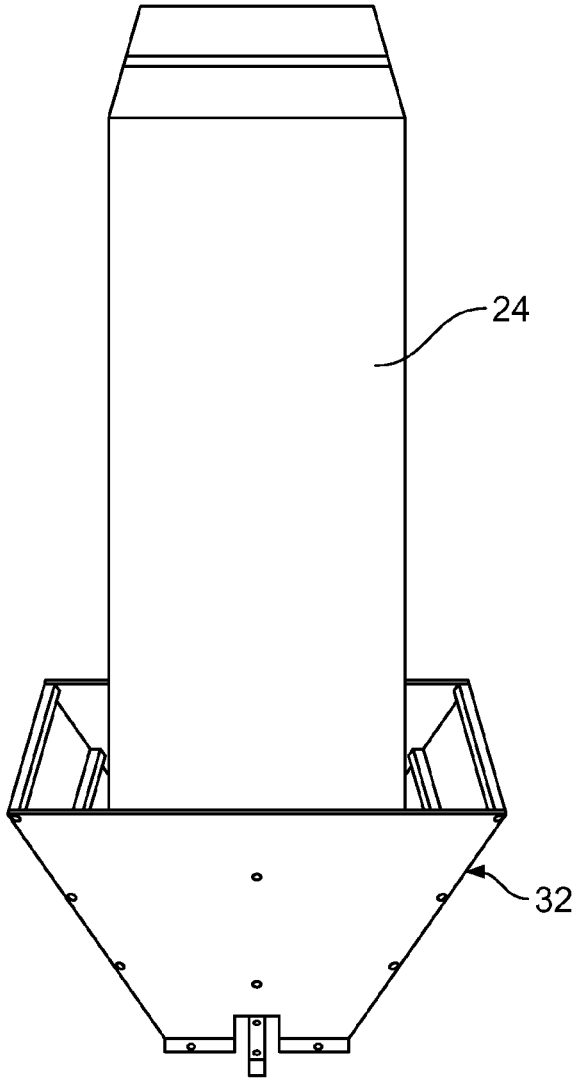
FIG. 3 is a photograph of a plane wave antenna of an embodiment of the present invention.

As shown in FIGS. 2A, 2B and 3, a waveguide 23 includes an upper dielectric slab 24, with a thickness of about 1 inch, a width of about 8 inches, and a length of about 17 inches, positioned above the central dielectric slab 10 (FIG. 1) and a lower dielectric slab 25, with a thickness of about 1 inch, a width of about 8 inches, and a length of about 17 inches, positioned below the central dielectric slab 10, with the central dielectric slab 10 being located in the space (or between the upper dielectric slab 24 and the lower dielectric slab 25. An upper slit 26 is located in the upper dielectric slab 24 and a lower slit 28 is located in the lower dielectric slab 25, which may be positioned about the ridges of the double ridge horn antenna 32 and secured by any suitable method, such as a pressure fit, glue, or mechanical ties. The material of the upper dielectric slab 24 and the lower dielectric slab 25 has a lower dielectric constant (about 1.1) than the dielectric constant of the material of the central dielectric slab 10 (e.g. polystyrene foam rectangles 1 inch thick each and of dielectric constant approximately 1.05). In one embodiment of the present invention, the upper and lower dielectric slabs 24, 25 have substantially the same dielectric constant.

Figure 4A:
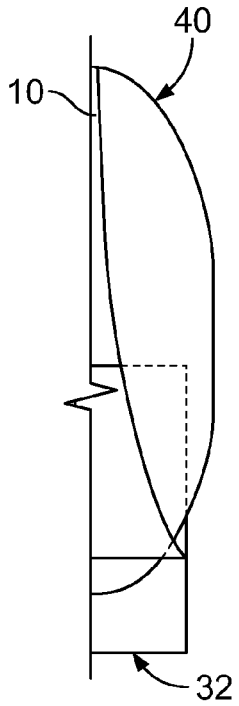
FIG. 4A is a side view of a plane wave antenna of another embodiment of the present invention.
Figure 4B:
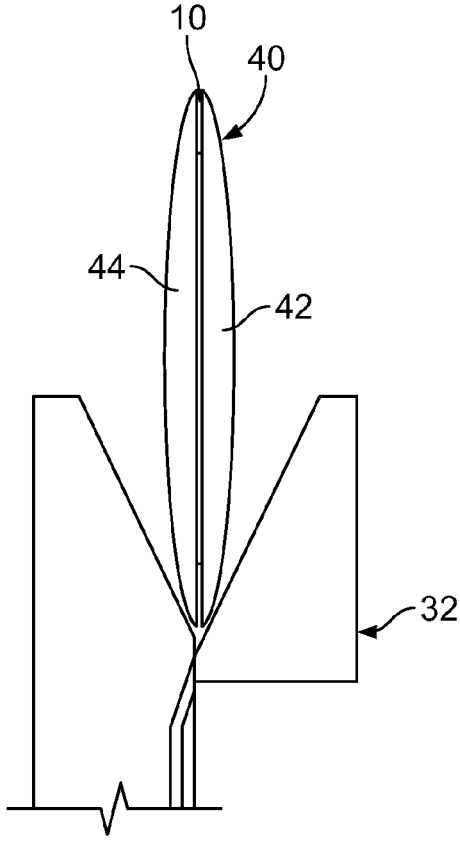
FIG. 4B is another side view of a plane wave antenna of another embodiment of the present invention.
Figure 5:
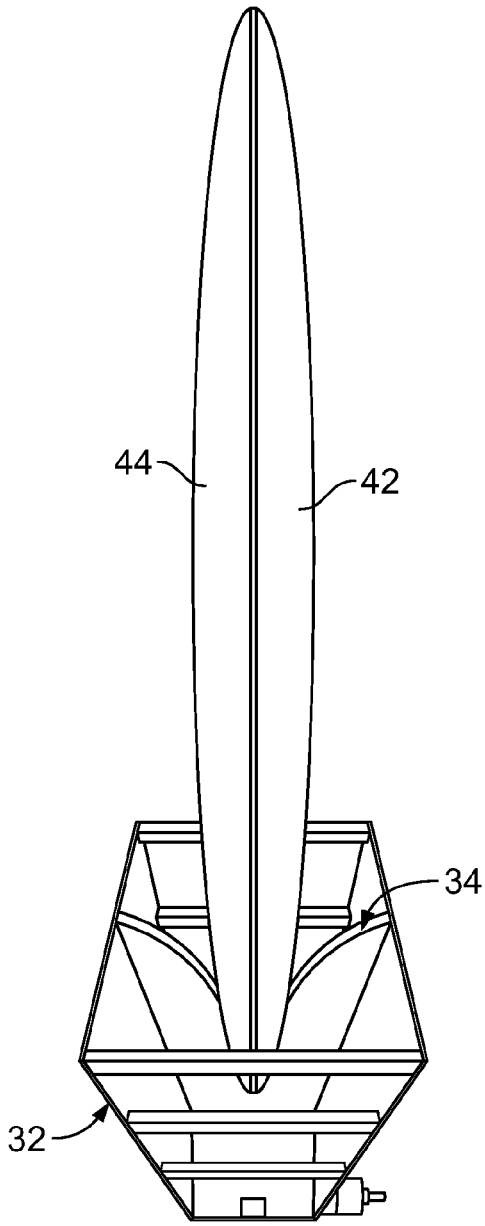
FIG. 5 is a photograph of the plane wave antenna of FIGS. 4A and 4B.
Figure 6:
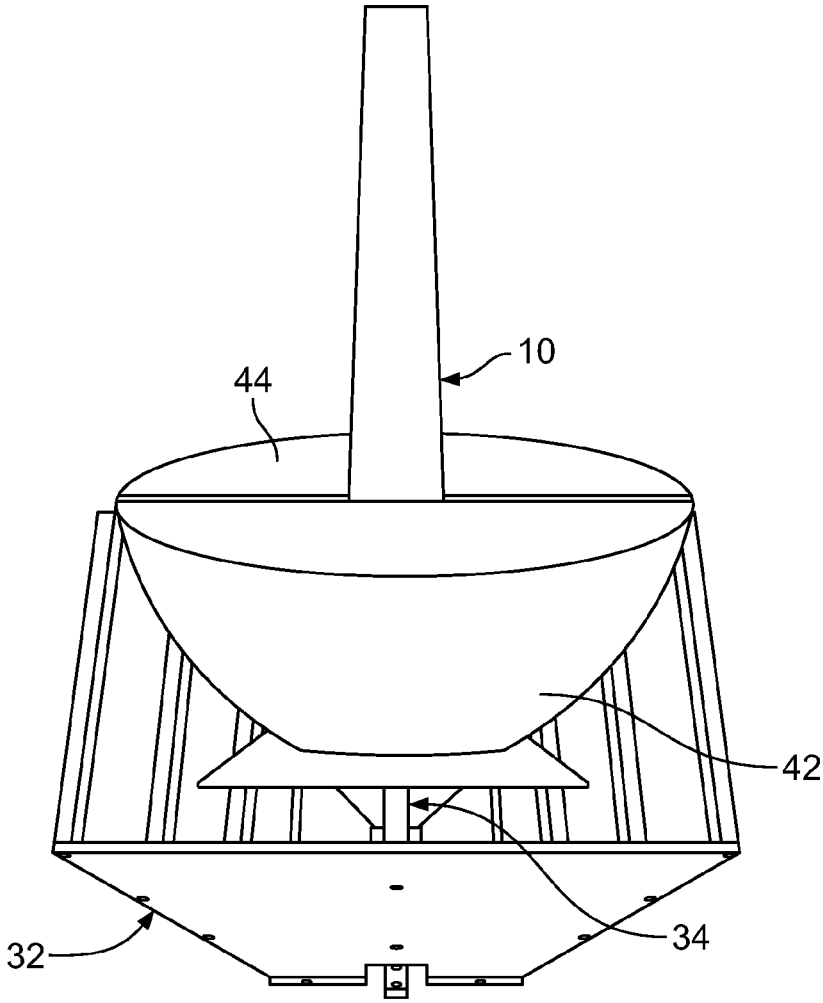
FIG. 6 is a photograph of a cut-away section of the plane wave antenna of FIGS. 4A and 4B.

As shown in FIGS. 4A, 4B, 5, and 6, a polyrod of another embodiment of the present invention, for operation in frequencies of about 200 MHz to about 20 GHz, includes an upper dielectric slab 42 and a lower dielectric slab 44 being made of materials with dielectric constants of about 1.4 (or in a range from about 1.2 to about 1.6) (e.g., balsa wood) and each of the slabs 42, 44 having an ellipsoid shape where its thickness is about 1/10th of its length and its width is about ½ of its length, which is positioned about the ridges 34 of the double ridge horn antenna 32. Further, the upper dielectric slab 42 and the lower dielectric slab 44 may each be spaced apart from the central dielectric slab 10 with an air gap by about 0.09 inches. FIGS. 4A and 4B also show that the double ridge horn antenna 32 may have a form of a straight-finned Vivaldi antenna with Top-Hat, however, other suitable commercially available double ridge horn antennas, such as the Singer A6100, may be utilized. One skilled in the art would be able to optimize a polyrod of the above configuration for a double ridge horn antenna (whether purchased commercially or fabricated in-house.)

Figure 7B:
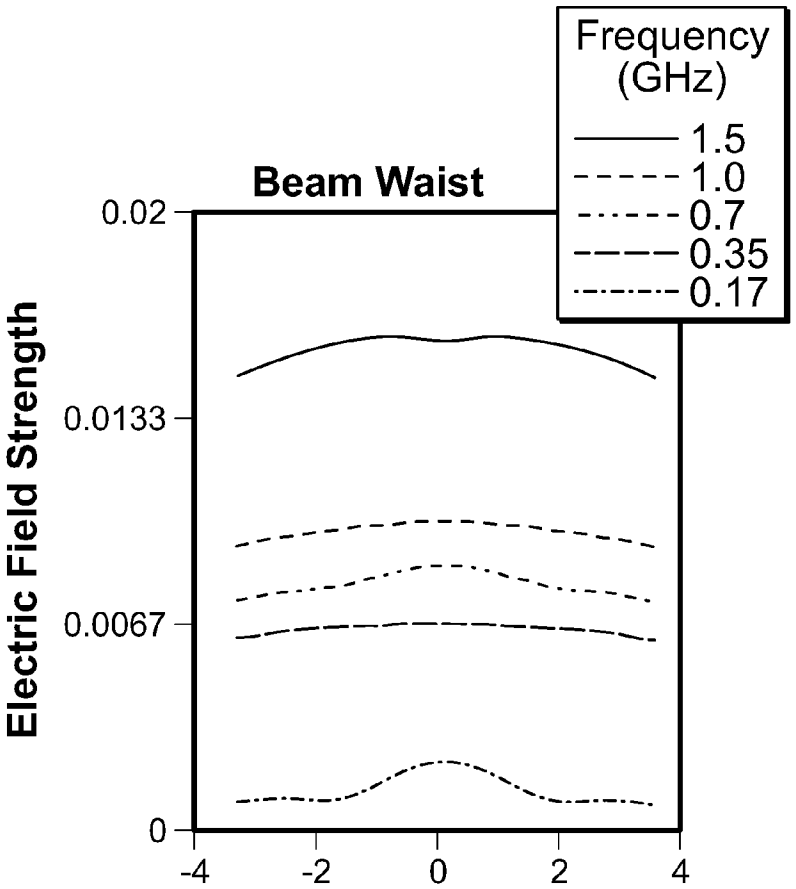
FIG. 7B is a graph of beam waist size vs. electric field strength for other selected frequencies.
Figure 7A:
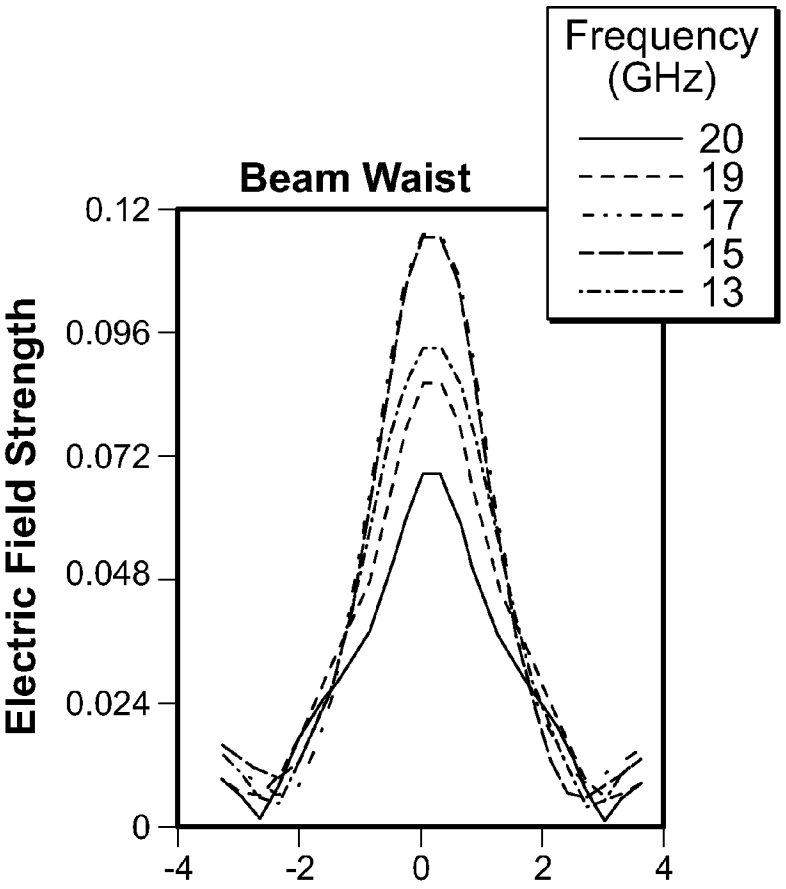
FIG. 7A is a graph of beam waist size vs. electric field strength for selected frequencies.

For any polyrod, the lowest frequencies are diminished, since the material of the polyrod becomes electrically thin. Therefore, the beam waist increases as frequency decreases, as seen in FIGS. 7A and 7B, eventually leading to a broad, uncollimated beam at lower frequencies. The polyrod of the present invention produces a smooth Gaussian beam at higher frequencies. However, a linear profile, produced by a triangular inner polyrod layer, produces a Gaussian beam with the higher frequencies being over-guided, resulting in a central beam being fringed by two very high side lobes, instead of the exponentially decaying tail seen in the FIGS. 7A and 7B.

Another embodiment of the present invention is directed toward a low-diffraction iris. In an admittance tunnel, a ground plane (or sample holder) with an iris aperture is interposed between two antennas to support the sample, force signals going from antenna to antenna through the sample instead of diffracting around the sample, and provide an isolation calibration reference (by covering the iris with a metal plate) for residual multi-path coupling signals between the antennas arising from imperfections in the tunnel. Waves are diffracted on an edge of the iris and radiate through the sample, eventually reaching the receiving antenna. Since the goal of the admittance tunnel is to mimic a plane wave, the diffracted waves result in undesired corruption of measurements.

Figure 8:
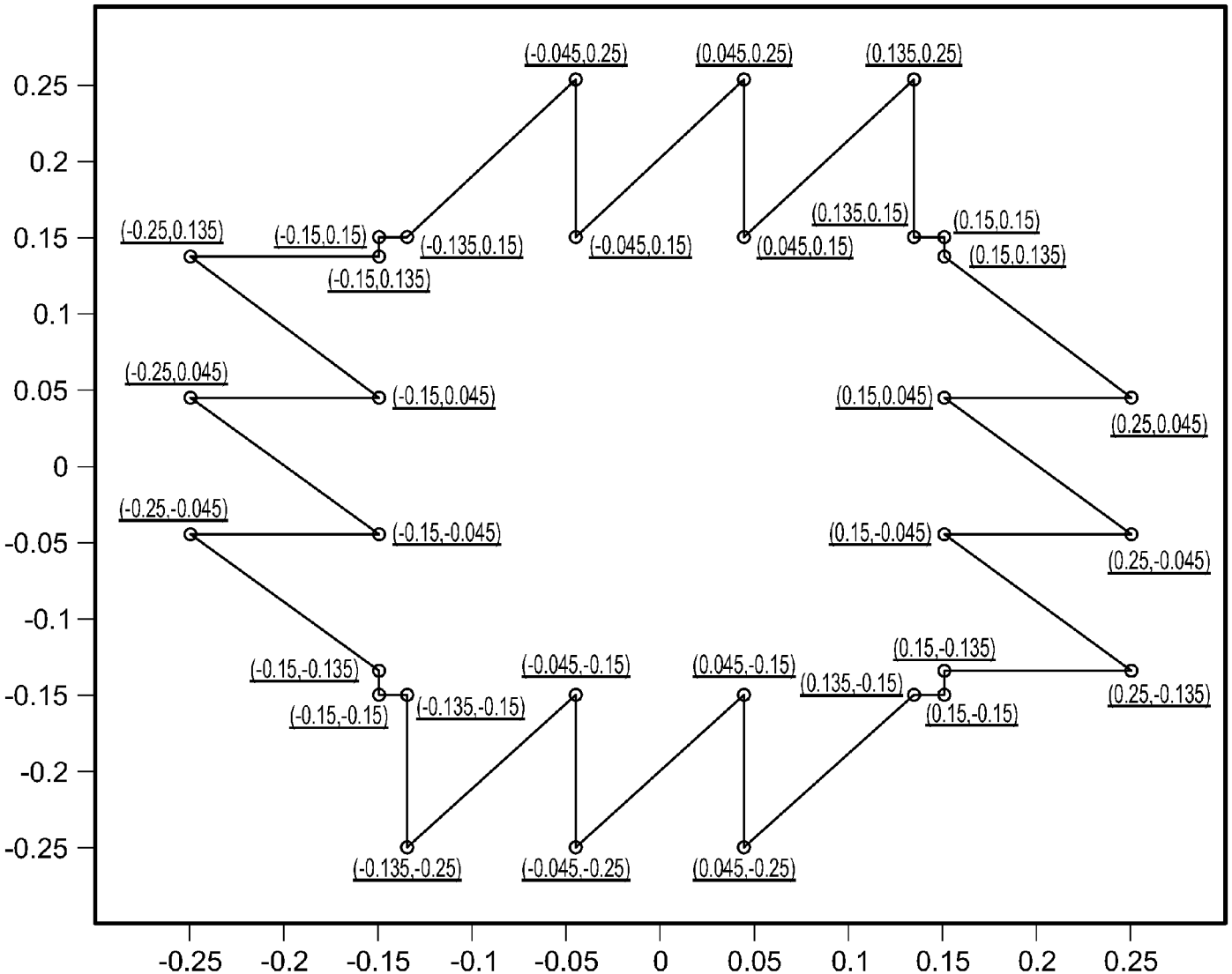
FIG. 8 is a schematic of an iris of another embodiment of the present invention.
Figure 9:
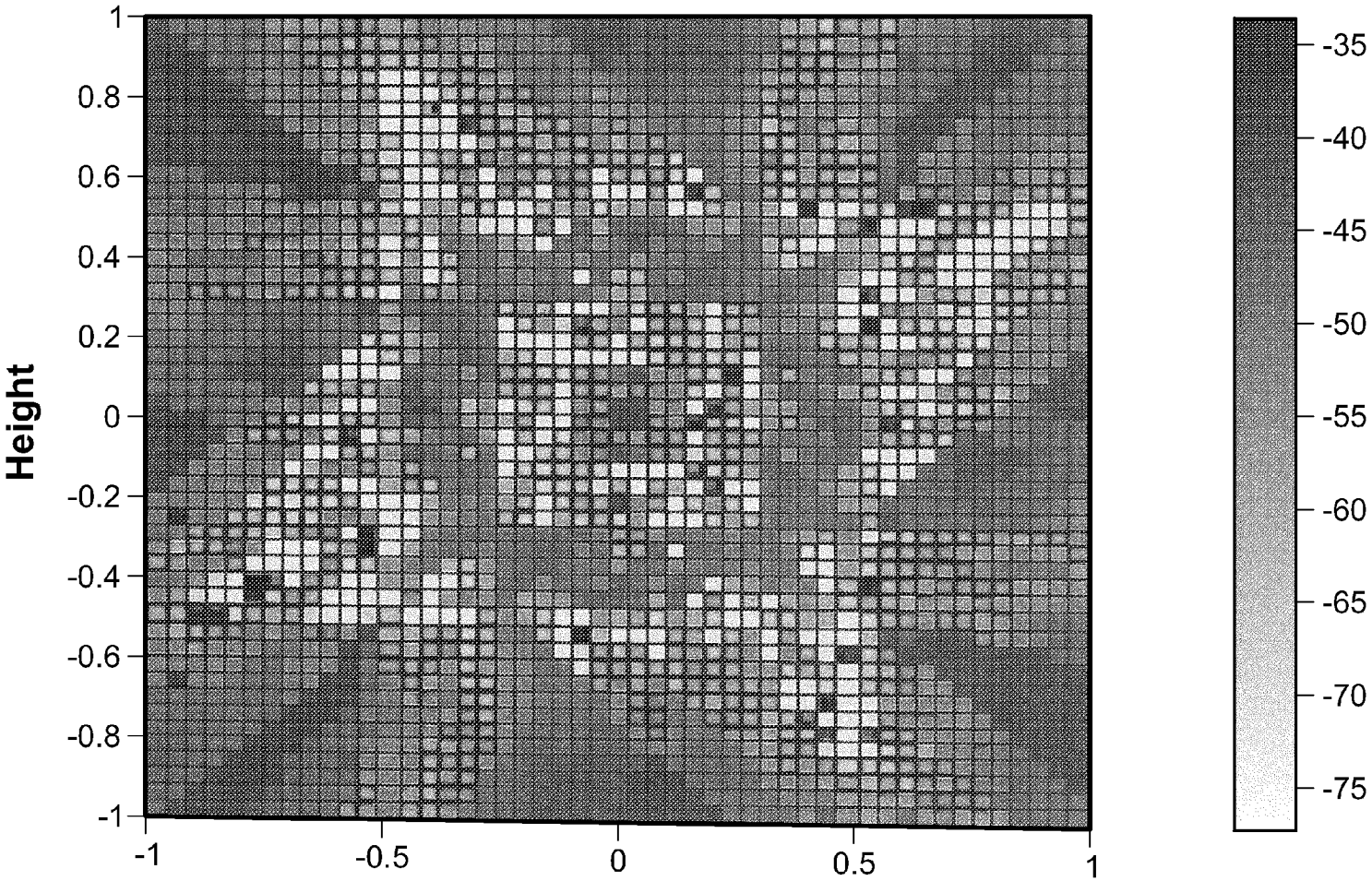
FIG. 9 is a graph of energy distribution one meter in front of the serrated iris as a result of the serrations' effect on the diffracted signal.

In compact radar ranges, serrated edges have been used to redirect diffracted energy away from the sample, mimicking plane waves in a quiet zone. The low-diffraction iris of an embodiment of the present invention works similarly. Serration depth, serration edge angle, and skew symmetry are aspects of the design of the low-diffraction iris. As shown in FIG. 8 illustrates one design of the iris, although variations of this design would not depart from the scope and spirit of the present invention. FIG. 9 shows a distribution of energy in a plane parallel to and about 3 feet away from the low-diffraction iris calculated by utilizing an asymptotic computational electromagnetic technique known as Uniform Theory of Diffraction.

Figure 10A:
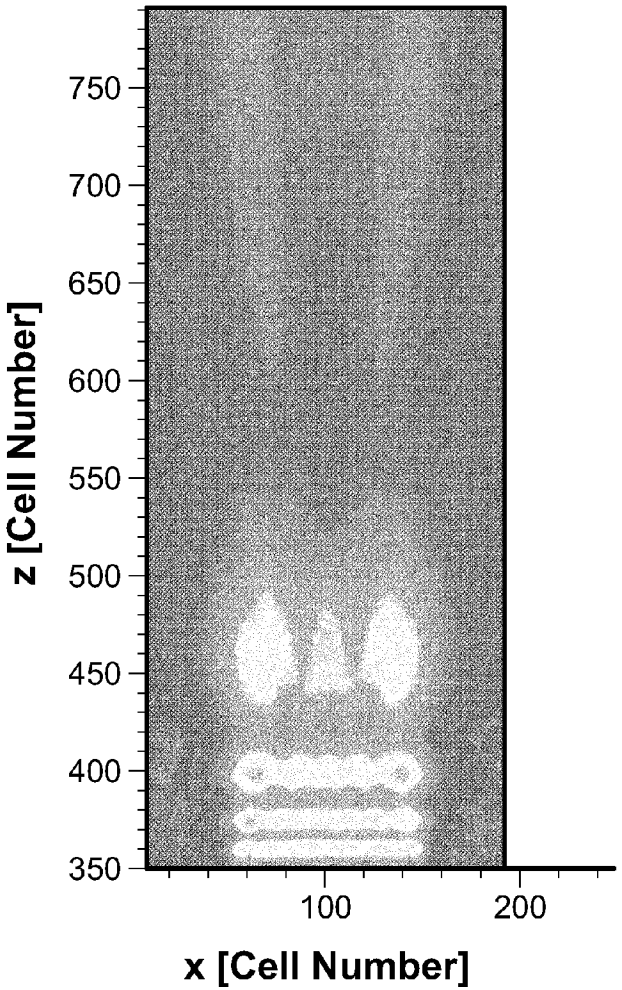
FIG. 10A is a top view of a Fresnel Zone for plane wave incidence at 10 GHz in front of a square iris.
Figure 10B:
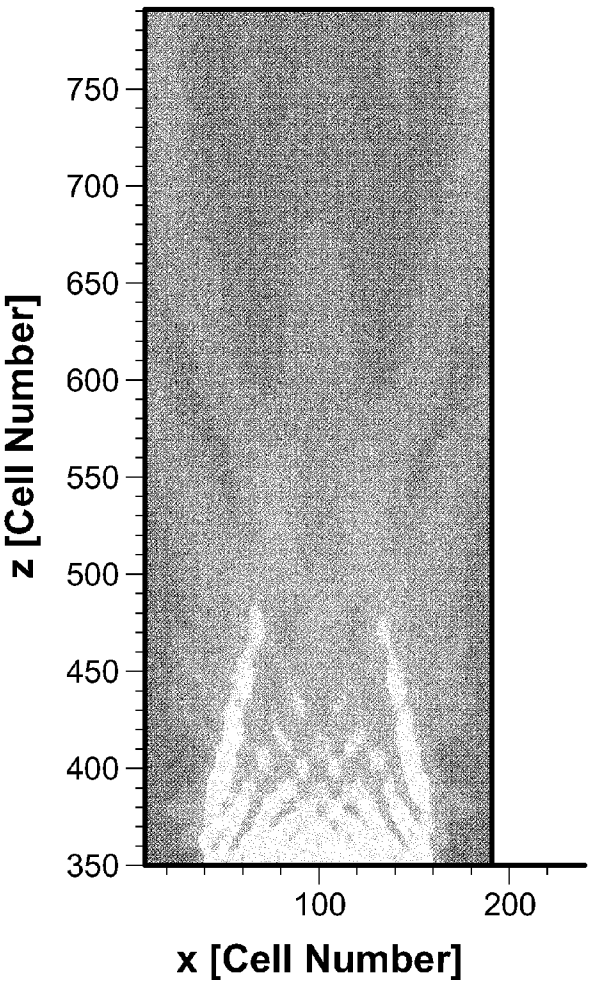
FIG. 10B is a top view of a Fresnel Zone for plane wave incidence at 10 GHz in front of an iris of an embodiment of the present invention.

FIG. 10A shows a top view of a Fresnel Zone for plane wave incidence at 10 GHz in front of a square iris, and FIG. 10B shows a top view of a Fresnel Zone for plane wave incidence in front of an serrated low-diffraction iris of the present invention, demonstrating that hot-spots created by the square iris reduce in strength and move away from the region with the serrated low-diffraction iris.

In an aspect of the present invention, a thin dielectric film with a resistive coating that may vary in surface resistance from a fraction of an ohm per square (in contact with the metal edge) to over a thousand ohms per square at the air-boundary may be applied to the serrated low-diffraction iris. Tapered, as well as constant value, resistive films may reduce iris diffraction. In one embodiment, a constant value film in the range from about 50 to about 70 ohms per square is applied to the serrated low-diffraction iris; edges of the film coincide with tips of the serrations.

An additional benefit of the present invention is an enhanced signal to noise ratio. A double ridge horn antenna provides stable gain over 0.7 GHz to 18.0 GHz as a broadband antenna. The polyrod of the present invention increases gain by about 8 dB towards 18.0 GHz. Furthermore, the double ridge horn antennas of the present invention may be closer to the sample than conventional antenna because the signal at the end of the polyrod is a plane wave, thus increasing through signal. According to conventional antenna theory, horn antennas must be in the "far field" to perform as plane wave sources. Using conventional admittance tunnels in the radiating near field (Fresnel zone) results in the sample being illuminated with a spherical wave and contributes to the anomalies described above.

Figure 11A:
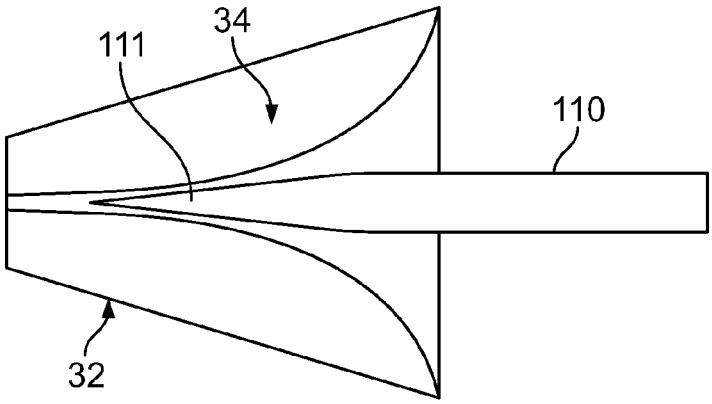
FIGS. 11A and 11B are a schematic view of other embodiments of the present invention.
Figure 11B:
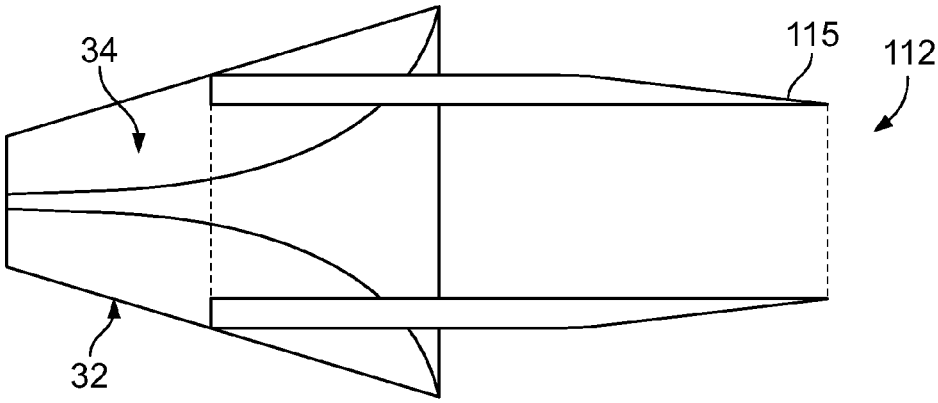

In other embodiments of the present invention, other polyrod shapes may be utilized the bandwidth of the frequency of operation is not as large as in the embodiments above (i.e., not as large as 200 MHz to 20 GHz). For example, a slender dielectric polyrod 110 that narrows towards an end 111 near the horn antenna 32, as shown in FIG. 11A, with a dielectric constant ($\in r$) of about 2 and length of about 10 inches, with a maximum cross section about 1 inch across, results in Gaussian beam operation from about 6 GHz through about 20 GHz without otherwise affecting the low frequency performance of the antenna. Also, a hollow dielectric pipe polyrod 112, as shown in FIG. 11B, with a dielectric constant ($\in r$) of about 2.9, diameter of about 4 inches, wall thickness of about 0.3 inches that narrows toward an end 115 away from the horn antenna 32, and length of about 20 inches, inserted into the ridges 34 will result in a gain increase and Gaussian beam operation from UHF frequencies through about 8 GHz.

It is understood that one skilled in the art may readily scale the polyrod and the compact admittance tunnel to desired frequency ranges by modifying the dimensions and verifying and optimizing the design using suitable computational electromagnetic tools. Similarly, a wide range of polyrod designs may be applied to ridge horn or Vivaldi antennas to obtain Gaussian beam performance. Accordingly, any such modifications are contemplated and are understood to fall with the sprite and scope of the present invention.

Likewise, other diffraction control techniques, such as reactive tapered films, may be applied to the iris.

Referring now back to FIGS. 1, 2A, 2B, 3, 4A, 4B, 5, and 6, an embodiment of the present invention provides a plane wave antenna including a horn antenna 32 and a waveguide 23, 40 at least partially inside the horn antenna 32. The waveguide 23, 40 includes a central dielectric slab 10 that increases in width toward the horn antenna 32 and has a first dielectric constant, an upper slab 24, 42 above the central dielectric slab 10 with a second dielectric constant, and a lower slab 25, 44 below the central dielectric slab 10 with the second dielectric constant. The central dielectric slab 10 has a substantially constant thickness less than a quarter of a wavelength at a highest frequency of operation of the plane wave antenna.

Referring now back to FIG. 8, the plane wave antenna may further include an iris between the waveguide and a test sample, and the iris may have a serrated edge.

Referring now back to FIG. 1, the central dielectric slab may have a curve 22 toward the horn antenna having an arctangent curve shape or an exponential curve shape or a polynomial curve shape toward the horn antenna.

Referring now back to FIGS. 4A, 4B, 5, and 6, the upper slab 42 and the lower slab 44 may have an ellipsoid shape. Further, the first dielectric constant may be higher than the second dielectric constant. Also, the upper slab 42 and the lower slab 44 may be spaced apart from the central dielectric slab 10. The horn antenna 32 may be a broadband double-ridged horn antenna.

Moreover, the upper slab 42 and the lower slab 44 may each be spaced apart from the central dielectric slab 10 with an air gap therebetween. The air gap may be about 0.09 inches. In addition, each of the upper slab 42 and the lower slab 44 may have an ellipsoid shape, and each of the upper slab 42 and the lower slab 44 may have a thickness of about 1/10th of its length and a width of about ½ of its length.

Referring now back to FIG. 12, another embodiment of the present invention provides a sample evaluating system 110 including a transmitter 122 for transmitting an evaluation signal, a receiver 120 for receiving the evaluation signal; and a sample holder 124 between the transmitter 122 and the receiver 120, the sample holder 124 including an iris having a serrated edge. The transmitter 122 includes a horn antenna and a waveguide at least partially inside the horn antenna Referring now back to FIGS. 1, 2A, 2B, 3, 4A, 4B, 5 and 6, another embodiment of the present invention provides a waveguide 23, 40 that includes a central dielectric slab 10 that increases in width toward the horn antenna 32 and has a first dielectric constant, an upper slab 24, 42 above the central dielectric slab 10 with a second dielectric constant, and a lower slab 25, 44 below the central dielectric slab 10 with a second dielectric constant.

Referring now back to FIGS. 1, 2A, 2B, 3, 4A, 4B, 5, 6, and 12, another embodiment of the present invention provides a method of manufacturing a plane wave antenna. The method includes forming a waveguide 23, 40. The method of forming the waveguide includes forming a central dielectric slab 10 with a first dielectric constant, wherein the central dielectric slab 10 is wider at a first end than at a second end, forming an upper dielectric slab 24, 42 with a second dielectric constant above the central dielectric slab 10; forming a lower dielectric slab 25, 44 with a second dielectric constant below the central dielectric slab 10; inserting at least a portion of the waveguide 23, 40 into a horn antenna. The method may further include forming an iris between the waveguide 23, 40 and a test sample 126, and the iris has a serrated edge.

In view of the foregoing, an embodiment of the present invention provides a layered dielectric polyrod coupled to a broadband doubled-ridged waveguide horn to approximate plane wave energy onto a sample in a compact domain. An embodiment of the present invention provides a resistively loaded serrated iris in a ground plane that is utilized to support a sample and provide an isolation plane between two antennas of an admittance tunnel. As a result, an embodiment of the present invention provides a substantial plane wave interaction between an electromagnetic wave and a sample at an operation frequency ranging from 0.7 GHz to 20.0 GHz.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A plane wave antenna comprising:

a horn antenna;

a layered waveguide at least partially inside the horn antenna, wherein the layered waveguide comprises:

a central dielectric slab increasing in width toward the horn antenna and forming a first layer of the layered waveguide, the central dielectric slab with a first dielectric constant, a second slab forming a second layer of the layered waveguide, the second layer adjacent to the central dielectric slab, the second slab with a second dielectric constant smaller than the first dielectric constant, and a third slab forming a third layer of the layered waveguide, the third layer adjacent to the central dielectric slab such that the central dielectric slab is between the second and third slabs, the third slab with the second dielectric constant; and wherein the central dielectric slab has a substantially constant thickness less than a quarter of a wavelength at a highest frequency of operation of the plane wave antenna.

2. The plane wave antenna of claim 1, further comprising an iris between the layered waveguide and a test sample, wherein the iris has a serrated edge.

3. The plane wave antenna of claim 1, wherein the central dielectric slab has an arctangent curve shape toward the horn antenna.

4. The plane wave antenna of claim 1, wherein the central dielectric slab has an exponential curve shape toward the horn antenna.

5. The plane wave antenna of claim 1, wherein the central dielectric slab has a polynomial curve shape toward the horn antenna.

6. The plane wave antenna of claim 1, wherein each of the second and third slabs has an ellipsoid shape.

7. The plane wave antenna of claim 6, wherein each of the second and third slabs has a thickness of about 1/10th of a length of the respective second and third slabs and a width of about ½ of the length of the respective second and third slabs.

8. The plane wave antenna of claim 6, wherein the second and third slabs are each spaced apart from the central dielectric slab with an air gap therebetween.

9. The plane wave antenna of claim 8, wherein the air gap is about 0.09 inches.

10. The plane wave antenna of claim 1, wherein second and third slabs are spaced apart from the central dielectric slab.

11. The plane wave antenna of claim 1, wherein the horn antenna is a broadband double-ridged horn antenna.

12. A sample evaluating system comprising:

a transmitter for transmitting an evaluation signal, the transmitter comprising a horn antenna and a layered waveguide at least partially inside the horn antenna, the layered waveguide including a central dielectric slab increasing in width toward the horn antenna and forming a first layer of the layered waveguide, the central dielectric slab with a first dielectric constant, a second slab forming a second layer of the layered waveguide, the second layer adjacent to the central dielectric slab, the second slab with a second dielectric constant smaller than the first dielectric constant, and a third slab forming a third layer of the layered waveguide, the third layer adjacent to the central dielectric slab such that the central dielectric slab is between the second and third slabs, the third slab with the second dielectric constant;

a receiver for receiving the evaluation signal; and a sample holder between the transmitter and the receiver, the sample holder comprising an iris having a serrated edge.

13. The sample evaluating system of claim 12, wherein the central dielectric slab has an arctangent curve shape toward the horn antenna or an exponential curve shape toward the horn antenna or a polynomial curve shape toward the horn antenna.

14. The sample evaluating system of claim 12, wherein the second and third slabs have an ellipsoid shape.

15. The sample evaluating system of claim 12, wherein the second and third slabs are spaced apart from the central dielectric slab.

16. The sample evaluating system of claim 12, wherein the horn antenna is a broadband double ridged horn antenna.

17. A method of manufacturing a plane wave antenna, the method comprising:

forming a layered waveguide, the method of forming the layered waveguide comprising:

forming a first layer of the layered waveguide from a central dielectric slab with a first dielectric constant, wherein the central dielectric slab is wider at a first end than at a second end, forming a second layer of the layered waveguide from a second dielectric slab with a second dielectric constant that is smaller than the first dielectric constant, the second dielectric slab adjacent to the central dielectric slab;

forming a third layer of the layered waveguide from a third dielectric slab with the second dielectric constant, the second dielectric slab adjacent to the central dielectric slab such that the central dielectric slab is between the second and third dielectric slabs;

inserting at least a portion of the waveguide into a horn antenna; and wherein the central dielectric slab has a substantially constant thickness less than a quarter of a wavelength at a highest frequency of operation of the plane wave antenna.

18. The method of claim 17, further comprising forming an iris between the layered waveguide and a test sample, wherein the iris has a serrated edge.

19. The method of claim 17, wherein the central dielectric slab is formed to have an arctangent curve shape toward the horn antenna or an exponential curve shape toward the horn antenna or a polynomial curve shape toward the horn antenna.

20. The method of claim 17, wherein the second and third slabs form an ellipsoid shape.

21. The method of claim 17, wherein the second and third slabs are spaced apart from the central dielectric slab.

22. The method of claim 17, wherein the horn antenna is formed to be a broadband double-ridged horn antenna.

* * * * *